United States Patent [19]

Samuel

[11] 4,305,070

[45] Dec. 8, 1981

[54] EMERGENCY ALARM SYSTEM FOR STATIC STRUCTURE UTILIZING AUTOMOBILE HORN

[76] Inventor: Herbert L. Samuel, 406 Russell St., Minden, La. 71055

[21] Appl. No.: 161,052

[22] Filed: Jun. 19, 1980

[51] Int. Cl.[3] ..... G08B 13/08; G08B 17/06; G08B 19/00

[52] U.S. Cl. ..... 340/691; 340/63; 340/533; 340/541; 340/593

[58] Field of Search ..... 340/691, 541, 63, 545, 340/547, 533, 593, 594

[56] References Cited

U.S. PATENT DOCUMENTS

| | | | |
|---|---|---|---|
| 1,223,060 | 4/1917 | Louthan | 340/63 |
| 2,686,909 | 8/1954 | Poulson | 340/541 |
| 3,513,466 | 5/1970 | Isaacs et al. | 340/63 |
| 3,569,929 | 3/1971 | Wood | 340/691 |
| 3,764,971 | 10/1973 | Brobeck | 340/63 |
| 4,090,182 | 5/1978 | Young | 340/545 |
| 4,218,763 | 8/1980 | Kelley et al | 340/541 |

*Primary Examiner*—Glen R. Swann, III

*Attorney, Agent, or Firm*—Scrivener, Clarke, Scrivener and Johnson

[57] ABSTRACT

Alarm circuitry in a static structure, e.g., a home, is connectable by plug and socket means to alarm circuitry in an automobile. The alarm circuitry in the automobile includes a relay powered from a source in the structure. Opening of alarm switches in the structure or on the automobile disables the relay to close a switch in the automobile horn circuit causing the horn to sound. The relay cannot be re-energized except by operation of re-set switch means located in the structure.

10 Claims, 1 Drawing Figure

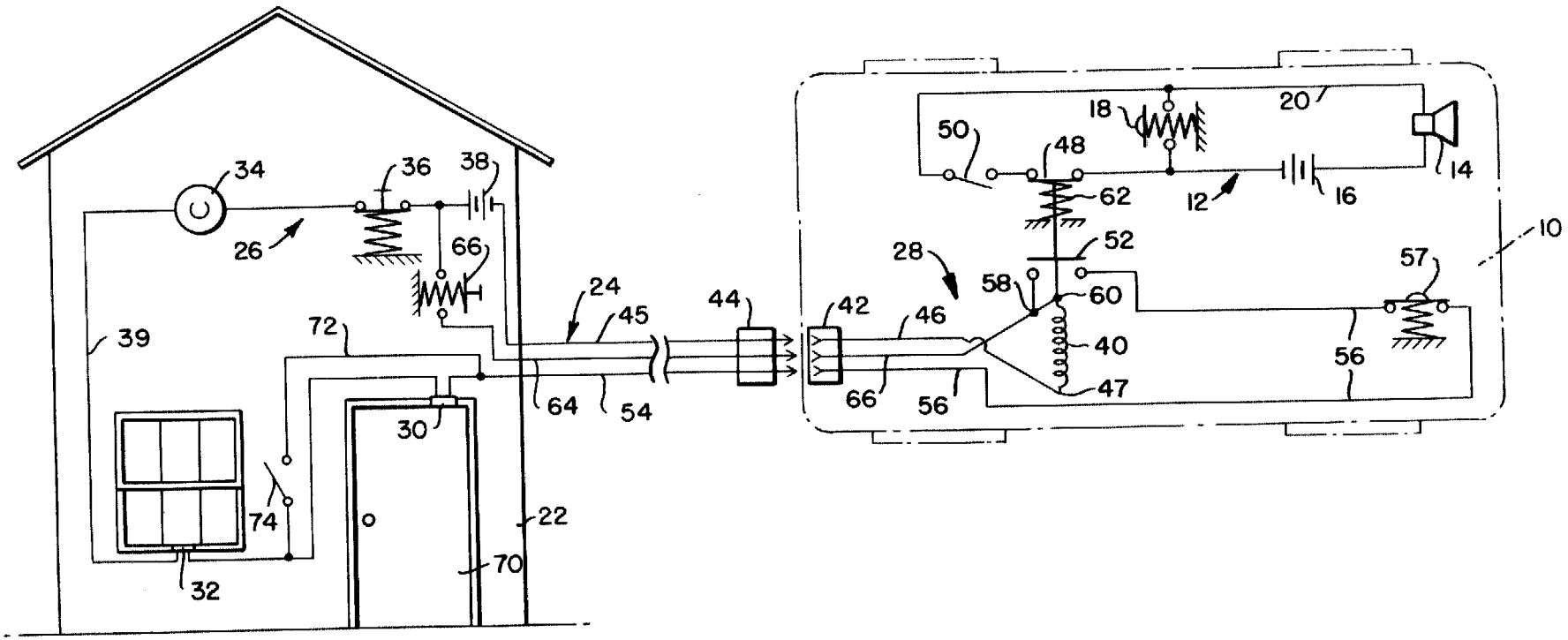
10
14
16
20
12
18
48
62
52
60
40
47
57
56
50
58
28
46
56
42
66
44
24
45
54
64
22
70
38
66
36
30
72
74
34
26
32
39

EMERGENCY ALARM SYSTEM FOR STATIC STRUCTURE UTILIZING AUTOMOBILE HORN

BACKGROUND OF THE INVENTION

This invention relates to alarm systems and more particularly to an alarm system for a static building structure, such as a home, which utilizes the horn of an automobile to produce an audible alarm in response to a variety of emergency conditions.

Burglar alarms are known which include the use of two independent power sources, one to control a relay and another to control an alarm which sounds upon de-energization of the relay in response to the forcing of an access opening in a building protected by the alarm. The relay includes holding means which must be re-set after the relay has been de-energized whereby, once de-energized to effect sounding of the alarm upon the opening of an access member, such as a door, the alarm cannot be turned off by the immediate closing of the door. Such a system is disclosed in the patent to Poulson U.S. Pat. No. 2,686,909.

It is also known to provide a protection system for automobiles whereby when an access is opened, say the hood, the horn is energized and continues to sound even though the hood is immediately closed. Such a system is disclosed in the patent to Louthan U.S. Pat. No. 1,223,060.

SUMMARY OF THE INVENTION

The object of the present invention is to provide an inexpensive alarm system for a structure, such as a house, which utilizes the horn of an automobile as the means for signaling an audible alarm in the event of an emergency in the house, such as an attempted burglary or fire.

Additionally, it is an object of the invention to also cause the horn to sound in the event an intruder attempts to tamper with the automobile.

BRIEF DESCRIPTION OF THE DRAWING

These and other objects will become apparent as the following detailed description is read in conjunction with the accompanying single view which is a schematic representation of the system in accordance with the invention.

DESCRIPTION OF THE PREFERRED EMBODIMENT

The numeral 10 designates an automobile which, as schematically illustrated, has an audible signal system 12 composed of a horn 14, a battery 16, a horn switch or button 18 and circuitry 20 connecting these units together in series. As is clear, when the button 18 is pushed, the circuit between the battery and horn is completed and the latter sounds. The foregoing is, of course, conventional.

The numeral 22 designates a static structure such as a house. Associated with the structure 22 and the automobile 10 is a protection circuit generally designated by the numeral 24. The protection circuit comprises a first portion, designated generally by the numeral 26, carried by the structure, and a second portion, designated generally by the numeral 28, carried by the automobile. The first portion includes at least one and preferably a plurality of normally closed alarm switch means such as door switch 30, window switch 32, a heat detector 34 and a manually operable switch 36, sometimes referred to as a "panic button", which may be located in a readily accessible position such as under a user's pillow, for use in the event of an emergency, such as sudden illness, or suspicious external noises, having no effect on any of the other alarm switches. The first portion of the protection circuit also includes an electric power source 38 which may be a 6 volt lantern battery, and circuitry 39 in the structure connecting the alarm switch means and the power source in series.

The second portion 28 of the protection circuit carried by the automobile includes a relay 40, and one half 42 of a plug and socket means which may be releasably connected to a second half 44 to connect by way of circuit parts 45, 46 one terminal 47 of the relay 40 to the power source 38 in the structure 22.

Associated with the relay 40 is a first relay switch 48 which is disposed in the horn circuitry 20 in parallel with the horn button 18. When the switch 48 is closed and a manually operable switch 50, whose location and function will be later described, is also closed, it will be apparent that a circuit between the automobile battery 16 and the horn 14 is completed so that the latter will sound independently of the operation of the regular horn button 18.

Also associated with the relay 40 is a second relay switch 52 which is connected by way of the plug and socket members 44, 42, circuit parts 54, 56, switch 57, whose function is later described, and connection 58 in series with a second terminal 60 of the relay 40. It will be apparent that when the second relay switch 52, switch 57, and all of the alarm switch means 30–36 are closed a circuit is completed from power source 38 in the structure, through the relay 40, switch 52 and said alarm switch means to energize the relay. When the relay is energized by the closing of second relay switch 52 then the first relay switch 48, which is connected to switch 52 for simultaneous movement therewith, must perforce be opened with the energized relay retaining the switches in the position just described against the force of biasing means, such as the spring 62, urging the switches to the position of the drawing wherein the first relay switch 48 is closed and the second relay switch is opened.

It will be apparent from the foregoing description, that so long as the second relay switch 52 is open, in the absence of re-set means, it would be impossible to energize the relay 40. In accordance with the invention, re-set means are provided and comprise an auxiliary circuit consisting of circuit parts 64, 66 which are also joined together by the plug and socket members 44, 42 to connect, through normally open switch 66, relay terminal 60 with the side of the power source 38 in structure 22, opposite the side to which the other relay terminal 47 is connected by way of circuit parts 45, 46 and plug and socket parts 42, 44. With this arrangement, it will be seen that with switch 52 initially open and switch 48 closed, when the re-set switch 66 in the structure 22 is momentarily closed a circuit is completed through switch 66, circuit parts 64, 66 and plug and socket parts 44, 42 to relay terminal 60 thereby energizing the relay and moving the two relay switches from the position shown to a position wherein the switch 52 is closed, thereby energizing the relay via the previously described circuit parts 54, 56, and opening the first relay switch 48. The re-set switch 66 need only be closed for a moment to effect re-setting of the relay.

It will be noted that the switch 57 in the second portion 28 of the protection circuit is normally biased to the open position. This switch is representative of any of a number of switches on the automobile which may be connected in series in the second portion of the protection circuit and arranged that when an access, such as the hood, or a door is opened, the switch is automatically opened to break the circuit to the relay causing the spring 62 to move the first relay switch to its closed position and, assuming the switch 50 to be also closed, to cause the horn to sound.

In order to prevent the horn from sounding when the door 70 of the structure is opened a shunt circuit 72 containing a switch 74 is provided around the door alarm switch 30. Desirably, the switch 74, which is normally open, is closed when one wishes to use the door in an authorized manner. If one is entering the structure, a key would be used to close the switch and after one has entered and closed the door, manually openable means on the inside of the house would be operated to re-open the switch 74.

In operation, let it be assumed that the automobile has just been driven into the garage for the night and all of the components are in the positions shown in the drawing; that is to say, the plug and socket parts 42, 44 have not been connected, the switch 50 is open and the relay switches 48, 52 are in the position shown, that is, switch 48 is closed and switch 52 is open. As a first order of business, the operator connects the two plug parts 42, 44. He then enters the house, after first closing the shunt switch 74, and pushes the re-set button which is preferably located in a concealed part of the house. This energizes the relay causing the switches 48, 52 to move from the position of the drawing to a position wherein the switch 48 is opened and the switch 52 closed thereby providing continuous energization of the relay to retain the switches in this position. The operator then returns to the automobile and closes the switch 50 which is located in the automobile in some concealed place such as under the dash board. He then locks the automobile doors, returns to the house and after closing the door 70, opens the switch 74 which arms the door switch 30. To make certain of this, the operator may test the system by pressing the "panic button" 36 momentarily which will break the circuit to the relay 40 causing the relay switch 48 to close and complete the circuit to the horn 14. As soon as the operator hears the horn sound, he momentarily pushes the re-set button and the horn should stop sounding immediately. Later should a window or door be forced by an intruder, the circuit to the relay is again broken and the horn is energized as just described and immediate closing of the window or door will not stop the horn from sounding.

It will be apparent from the foregoing that should an intruder attempt to disarm the system by disconnecting the plugs 42, 44 the relay is again de-energized, so that switch 48 closes to sound the horn. Replacing the plug parts will have no effect for the reasons explained above.

When the operator wishes to drive the automobile, he first closes the shunt switch 74, opens the door 70, unlocks the automobile doors and then opens the switch 50. Thereafter the plug parts are separated whereupon the relay switches move to the position of the drawing but this has no effect in view of the fact that the switch 50 is open. The automobile may then be driven away and its horn operated in the normal manner.

The invention is particularly well adapted to being supplied in an inexpensive kit form. The relay 40 may be commercial and contained in a small box easily installed by an owner in his automobile. The circuitry is simple and easily installed by a homeowner and since the only voltages involved are the low voltages of a lantern and an automobile battery there is no danger of shock to the homeowner. The major expenses of an alarm system are the cost of installation, as well as the expense of an audible signal unit. Too often, the signaling unit is clearly visible to a would-be intruder and he would, as a first order of business, take steps to try to disable the unit. With the automobile horn being used as the signaling unit, a first-time intruder would be taken by surprise and even if he were to return and endeavor to disable the system by pulling apart the plug parts or opening the hood to disconnect wires, the horn would again immediately sound.

It will be recognized by those skilled in the art to which the invention pertains that it is susceptible to a variety of changes and modifications, without, however, departing from the spirit and scope of the appended claims.

What is claimed is:

1. An alarm system for a static structure comprising an automobile, an audible signal system carried by said automobile, said system including a horn, an automobile battery, a horn switch and circuitry connecting said horn, battery and switch in series whereby closing of said switch energizes said horn to produce an audible signal, in combination therewith a protection circuit comprising a first portion carried by said static structure and including at least one normally closed alarm switch means movable to open position in response to an emergency condition, an electrical power source and circuitry connecting said alarm switch means and said source in series, a second portion carried by said automobile and including a relay coil, relay circuitry including plug and socket means for connecting one terminal of said relay coil to said power source carried by the static structure, a first relay switch connected to said horn circuit in parallel with said horn switch and a second relay switch connected by said plug and socket means in series with said alarm switch means and a second terminal of said relay coil, means biasing said first and second relay switches to a first (respectively, closed and opened) position, and means for simultaneously moving said switches to a second (respectively, opened and closed) position, whereby the opening of said normally closed alarm switch means disconnects said power source from said relay coil, allowing said relay switches to return to their first position, the first said relay switch thereby actuating said horn.

2. The alarm system of claim 1 wherein the means for moving said switches from their first to their second positions comprises means for selectively energizing said relay coil from the power source in said structure.

3. The alarm system of claim 2 wherein said energizing means comprises circuitry which connects, through said plug and socket means, the second terminal of said relay with the power source in said structure, and a re-set switch in said circuitry within said structure and biased at all times to open position but selectively movable momentarily to closed position to energize said relay to effect movement of said relay switches to their second positions.

4. The alarm system of claim 1 wherein the circuitry in said structure includes a plurality of normally closed alarm switch means each movable to an open position in response to a predetermined condition.

5. The alarm system of claim 4 wherein at least one of said alarm switch means is a heat detector switch.

6. The alarm system of claim 4 wherein at least one of said alarm switch means is movable to open position in response to opening of a door, and includes a shunt portion in parallel with said switch means, said shunt portion including a switch selectively closeable to bypass said last mentioned alarm switch means to enable the opening of said door without energizing said automobile horn.

7. The alarm system of claim 1 wherein said alarm switch means cincludes a normally closed, manually openable switch.

8. The alarm system of claim 1 wherein the second portion of the protection circuit includes a switch normally biased to open position and located so as to be moved to closed position in response to movement of an access member on the automobile to closed position.

9. The alarm system of claim 8 wherein the access member is the hood of the automobile.

10. The alarm system of claim 1, including a manually operable switch on said automobile in series with said first relay switch and said horn, the opening of said switch disabling operation of said horn upon closing of said first relay switch.

* * * * *